United States Patent [19]

Liedke

[11] 4,017,996

[45] Apr. 19, 1977

[54] SEAR-DISCONNECTOR FOR FIREARMS

[75] Inventor: Carl F. Liedke, North Haven, Conn.

[73] Assignee: O. F. Mossberg & Sons, Inc., North Haven, Conn.

[22] Filed: Mar. 4, 1976

[21] Appl. No.: 663,866

[52] U.S. Cl. ..... 42/69 B; 89/144

[51] Int. Cl.[2] ..... F41C 19/00

[58] Field of Search ..... 42/69 B, 69 R, 16, 17, 42/20; 89/141, 144

[56] References Cited

UNITED STATES PATENTS

| | | | |
|---|---|---|---|
| 2,675,638 | 4/1954 | Crittendon | 42/69 B |
| 3,314,183 | 4/1967 | Center | 42/69 B |
| 3,362,096 | 1/1968 | Rowe, Jr. | 42/69 B |

*Primary Examiner*—Charles T. Jordan
*Attorney, Agent, or Firm*—St.Onge Mayers Steward & Reens

[57] ABSTRACT

A disconnector for the trigger mechanism of a repeating firearm, in which the trigger must be disconnected from the sear during the reloading cycle so that the sear can re-engage and cock the firing member even though the trigger is still retracted when the reloading cycle is complete. The disconnector is directly engaged by a portion of the reciprocating breech-bolt mechanism in order to disconnect the sear, rendering the trigger inoperative until it is released by the shooter.

2 Claims, 4 Drawing Figures

SEAR-DISCONNECTOR FOR FIREARMS

BACKGROUND OF THE INVENTION

The invention relates to trigger mechanisms for repeating firearms, and it relates more particularly to a device for disconnecting the sear from the trigger after the trigger is retracted, so that only one cartridge is fired each time the trigger is pulled.

In sporting arms capable of being reloaded and fired rapidly, it is essential during reloading that the hammer or other firing member be held in its cocked position by the sear when the bolt moves forward after cocking the hammer, and that the trigger be released after each cartridge is fired in order to reset the trigger mechanism for firing the next round. This is accomplished by disconnecting the sear from the trigger during the reloading cycle so that the sear is free to re-engage the firing member even though the trigger may be held in its retracted position. A well-known and highly reliable type of sear-disconnector for this purpose is shown and described in U.S. Pat. No. 2,675,638 to Crittendon. In the Crittendon design, the disconnector is pivotally mounted on the trigger for engagement with the sear such that when the trigger is pulled, the sear is moved out of engagement with the hammer, allowing it to fall. During the reloading cycle, the disconnector is moved to an inoperative position freeing the sear to move back to its operative position for cocking engagement with the hammer. In order to fire the next round, it is first necessary to release the trigger so that the disconnector can return to its normal position for operative engagement with the sear when the trigger is again pulled.

In the Crittendon design, the disconnector is moved to its inoperative position by the hammer as it falls, so that the sear is released before the hammer is cocked during retraction of the breech-bolt mechanism. Consequently, as the hammer is pivoted back into cocked position, it engages the sear and moves it against the pressure of the sear spring far enough to allow the nose of the sear to catch within the sear-notch on the hammer and in so doing rubs against the sear edge. Such rubbing action causes wear at this critical point, as well as the formation of burrs on the sear edge which result in unsatisfactory trigger-pull. Another disadvantage of this arrangement is that it is necessary to provide a separate lever between the hammer and disconnector for rendering the disconnector inoperative when the hammer falls.

An object of the present invention is to simplify the type of disconnector employed in the above-identified Crittendon patent. Another object is to provide a disconnector which does not release the sear when the gun is fired until the hammer has been moved by the breech-bolt mechanism to its cocked position, thereby eliminating the rubbing action of the hammer on the sear as the hammer is being cocked.

SUMMARY OF THE INVENTION

The invention resides in providing a disconnector that is pivotally mounted on the trigger with a finger portion which extends into the path of the reciprocating breech-bolt mechanism for engagement thereby on retraction of the bolt. As the breech-bolt mechanism is retracted, it comes in contact with the finger portion of the disconnector, pivoting the disconnector to an inoperative position. A foot portion on the disconnector is located on the opposite side of its pivot point from the finger portion for operative engagement with the sear as the trigger is pulled to release the firing member. Thus, when the trigger is pulled the foot portion of the disconnector moves the sear out of cocking engagement with the firing member for discharging a cartridge. As the breech-bolt mechanism retracts to reload the gun, it drives the firing member into its cocked position, and also engages the finger portion of the disconnector to move its foot portion out of engagement with the sear, thereby releasing the sear for cocking engagement with the firing member.

The finger portion of the disconnector is desirably located at a point where it is not engaged by the breech-bolt mechanism until after the hammer has been driven to its cocked position, so that the sear is held out of engagement with the firing member until the latter is fully cocked, thereby preventing the hammer from coming in contact with the sear as it is being cocked, and therefore also preventing it from rubbing against the sear edge.

DESCRIPTION OF THE PREFERRED EMBODIMENT

Figure 1:
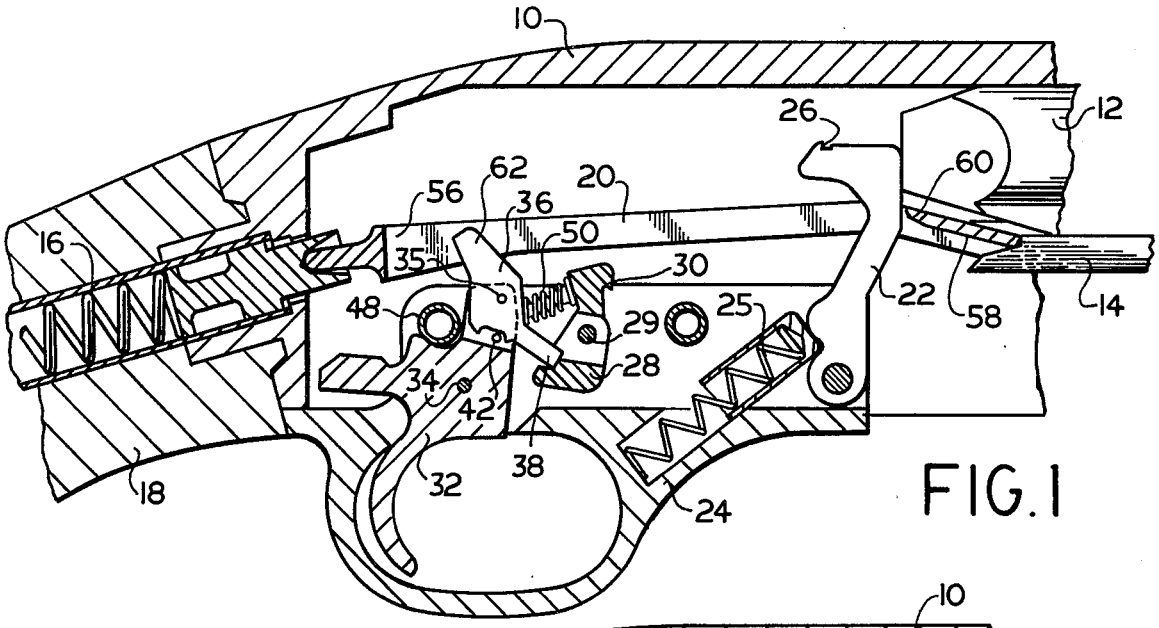
FIG. 1 is a vertical cross-sectional view through part of the receiver of a repeating firearm, showing the trigger mechanism and disconnector of the present invention, the parts being shown at the instant the gun is being fired with the trigger pulled and the hammer released.

The embodiment of the invention shown in the drawings is described in connection with an automatic shotgun having a receiver 10, in which the breech-bolt mechanism reciprocates during each reloading cycle between a breech-closing position and a retracted position. The breech-bolt mechanism in this instance consists of a bolt 12, a slide member 14 (FIG. 3) on which the bolt 12 is carried into and out of breech-closing position, an action-return spring 16 in the stock 18 and a strut or link 20 connecting the slide member 14 to the action-return spring.

A hammer 22 is pivotally mounted on the trigger plate 24 for pivotal movement between its fired position and a cocked position, and is driven to its fired position by a hammer spring 25. Hammer 22 is provided with a cocking notch 26, by which it is held cocked by a sear 28 pivotally mounted at 29 on trigger plate 24 rearward of hammer 22. A hooked nose 30 on sear 28 engages the cocking notch 26 when hammer 22 is pivoted rearward (counterclockwise as viewed in the drawings) to its cocked position against the pressure of spring 25.

A trigger 32 is pivoted in the usual manner on a trigger pin 34 fixed in trigger plate 24. Pivotally mounted on a pin 35 in the upper portion of trigger 32 is a disconnector 36, which has a forwardly and downwardly projecting foot portion 38 disposed for engagement with an actuating notch 40 in the lower part of sear 28. Pivotal movement of disconnector 36 on trigger 32 is limited by a stop-pin 42 fixed in the trigger and disposed within an elongated notch 44 in the under edge of disconnector 36. As shown in FIG. 1, disconnector 36 is pivoted clockwise until one end of notch 44 engages stop-pin 42, thereby preventing further clockwise movement of the disconnector relative to trigger 32. Tnus, when trigger 32 is pulled, disconnector 36 is prevented from pivoting clockwise about pin 35 as foot portion 38 engages within actuating notch 40 of the sear, causing the sear to pivot in a counterclockwise direction. Pivotal movement of trigger 32 about trigger pin 34 is limited by engagement of the opposite end-walls of a depression 46 in the upper edge of the trigger against a cross pin 48 through trigger plate 24.

Figure 4:
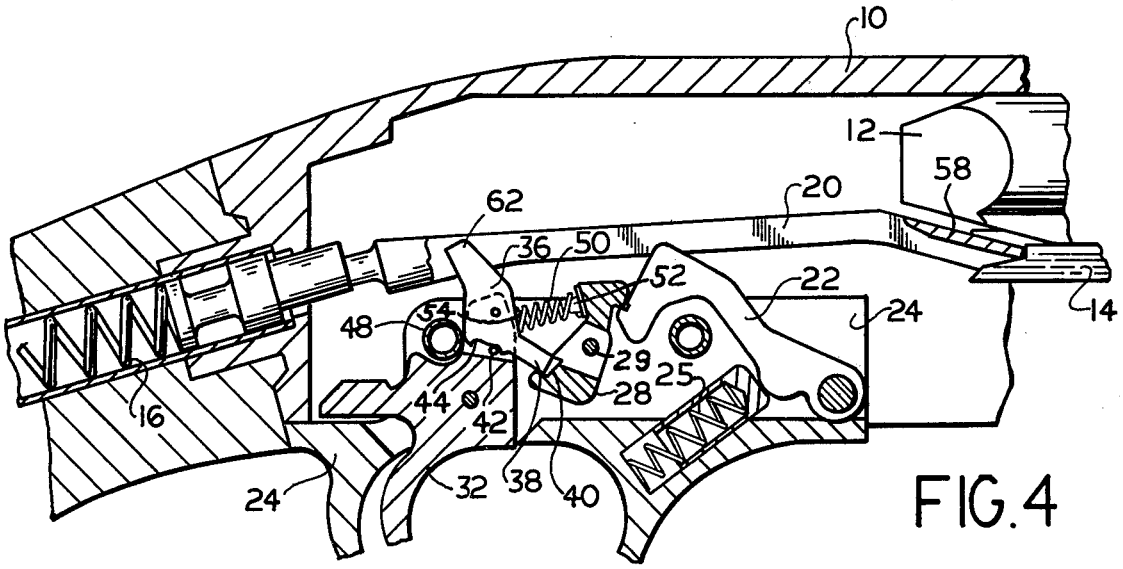
FIG. 4 is a view similar to FIGS. 1 and 2, but showing the parts in their normal positions when the gun is cocked and ready to fire.

Trigger 32, disconnector 36 and sear 28 are all urged into their normal positions illustrated in FIG. 4 by a coil spring 50, which is compressed between a locating lug 52 on the upper rear side of sear 28 above its pivot pin 29 and a similar lug 54 on the front edge of disconnector 36 below the pivot pin 35. When trigger 32 is retracted in order to release the hammer, the foot portion 38 of disconnector 36 presses downward and forward against the actuating notch 40 of sear 28, causing the sear to pivot counterclockwise out of cocking engagement with the hammer, as illustrated in FIG. 1, where the trigger is shown fully retracted and the hammer at its point of impact with the firing pin in bolt 12.

The strut 20 of the bolt-mechanism is an elongated member having a centrally disposed longitudinal slot 56 (FIG. 1) that extends from a cross-piece 58 at its front end, where it contacts slide 14 (FIG. 3), to a plunger-engaging lug at its other end. Hammer 22 fits upwardly through slot 56 so that it is free to swing between its cocked position as shown in FIG. 4 and its fired position (FIG. 1). The rear and underside of the cross-piece 58 at the front end of slot 56 forms an engagement surface 60 which engages the hammer, driving it rearward into its cocked position as the bolt retracts.

Figure 3:
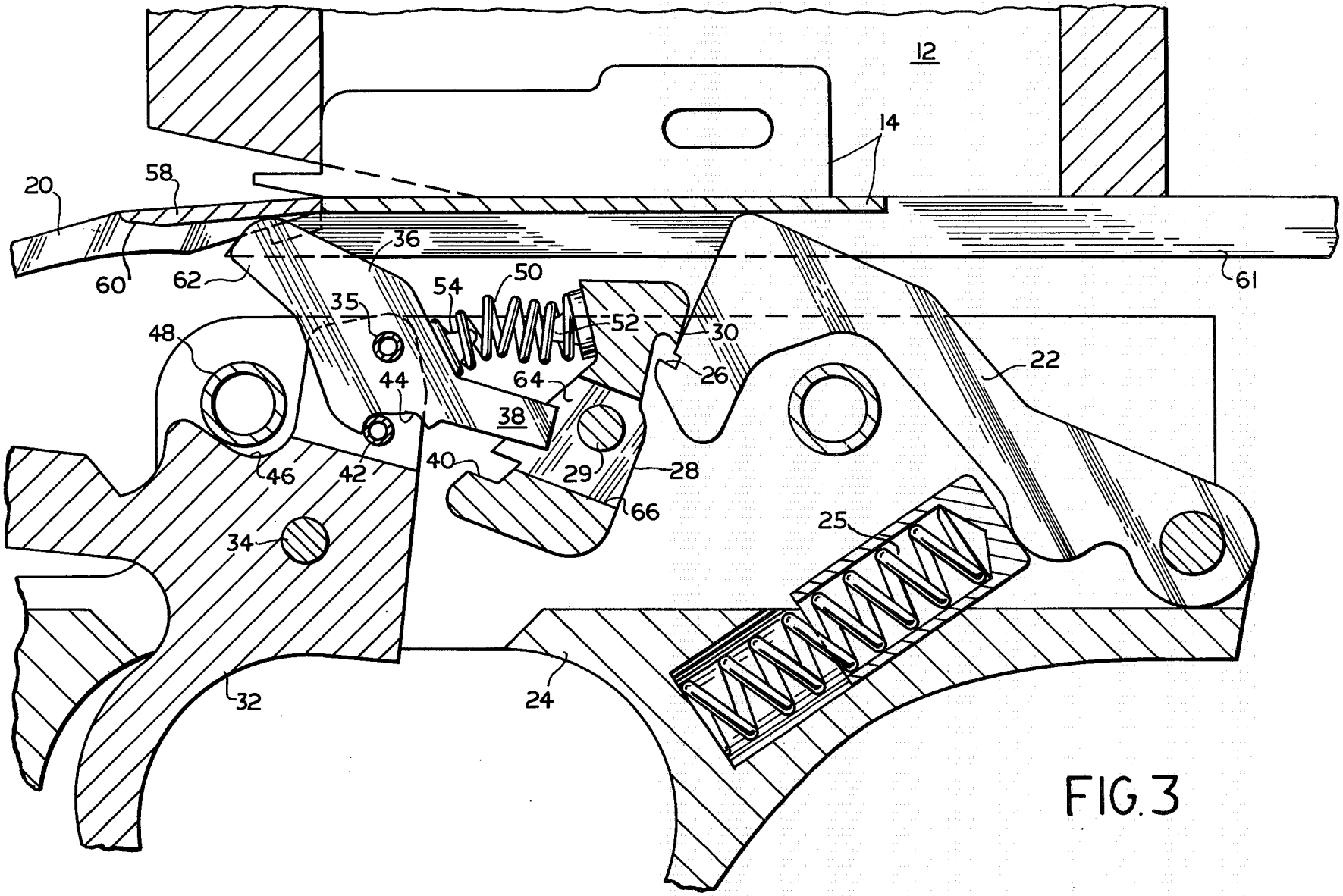
FIG. 3 is an enlarged view of the action with the bolt mechanism fully retracted and about to start its return stroke, the trigger being held in the retracted position by the shooter during the reloading cycle following discharge of a cartridge.

Actuation of the bolt in this instance is accomplished either manually by means of a finger piece (not shown) on bolt 12, or automatically by a gas-cylinder (likewise not shown) forward of the receiver 10 through a pair of action-bars 61, one of which is shown in FIG. 3. Action bars 61 are rigidly connected to and form part of the slide 14 for reciprocating bolt 12. In so-called pump-action firearms, in which the present invention may be employed, actuation of the bolt is of course accomplished manually by means of a conventional fore-end grip, to which the action-bars 61 may be connected.

The present invention resides specifically in providing disconnector 36 with an integral finger 62 that projects upward into the path of the breech-bolt mechanism as it retracts during the reloading cycle, so that the disconnector is pivoted counterclockwise near the end of the rearward stroke of the bolt in order to release sear 28 in time to again cock hammer 22. The finger 62 is accordingly provided with a curved front edge for engagement by the surface 60 of the breech-bolt mechanism.

Figure 2:
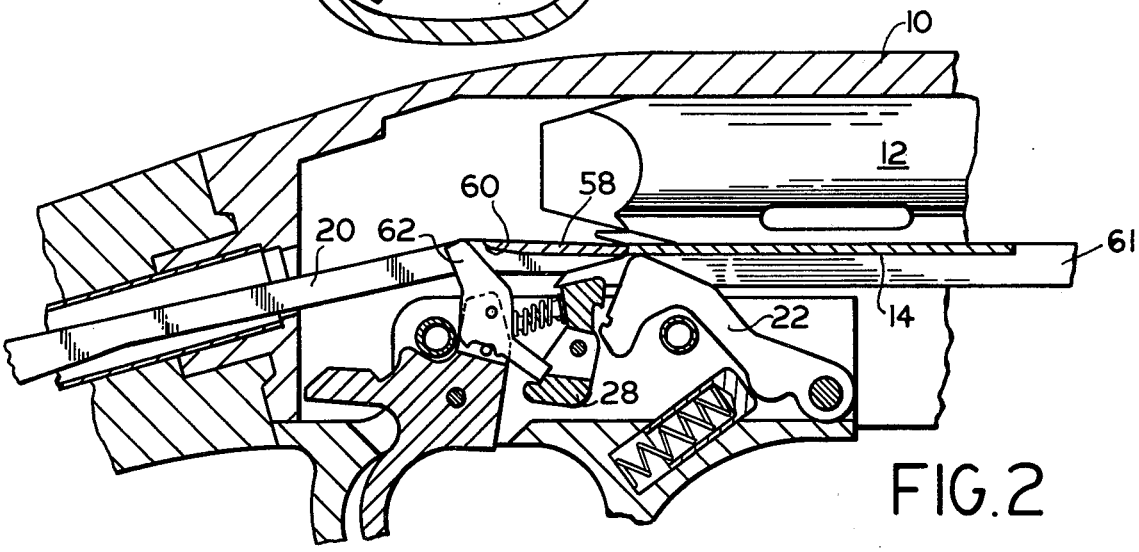
FIG. 2 is a view similar to FIG. 1 but showing the bolt mechanism partially retracted during the start of the reloading cycle.

As will be noted in FIG. 2, when the bolt is retracted against the pressure exerted on it by the return-spring strut 20, the engagement surface 60 first contacts hammer 22, pivoting it rearward (counterclockwise) into its cocked position before engaging the finger 62 of disconnector 36. Because autoloading firearms reload so rapidly that the shooter cannot release his trigger finger before the reloading cycle is complete, the trigger is held in its fully retracted position throughout. Consequently, as the bolt mechanism moves rearward as shown in FIG. 2, the trigger is held retracted and the sear is withdrawn from engagement with the hammer. However, as soon as the engagement surface 60 on strut 20 comes in contact with disconnector finger 62, it pivots the disconnector rearward to the position shown in FIG. 3, thereby lifting the foot portion 38 of disconnector 36 out of the notch 40 on sear 28 into a cutout 64 in the side of the sear, so that the sear is free to pivot clockwise under the urge of spring 50 into engagement with the hammer above the cocking notch 26.

When the bolt mechanism is driven forward by action-return spring 16 into its battery position, hammer 22 pivots upward a short distance until cocking notch 26 engages with the hook 30 on sear 28. Disconnector 36 is released as soon as the bolt starts forward and pivots clockwise under the pressure of spring 50. It will be noted, however, that the foot portion 38 of the disconnector does not immediately re-engage with the actuating notch 40 on the sear, but rests on the bottom 66 of cutout 64 in an inoperative position until the trigger is released. Pivotal movement of trigger 32 in a counterclockwise direction as shown in the drawings under the urge of spring 50, draws the end of foot portion 38 into alignment with the notch 40 so that it can drop into the notch for operative engagement therewith. The trigger mechanism is thus re-set so that another round is fired when the trigger is pulled again.

It will be noted that the disconnector 36 is extremely simple in design and is positively actuated by the bolt-mechanism instead of indirectly through a separate actuator as in prior designs, such as that disclosed in the hereinbefore-mentioned patent to Crittendon U.S. Pat. No. 2,675,638. The present disconnector consists of only one part which releases and re-engages the sear by direct action of the bolt-mechanism as it reciprocates during reloading. Furthermore, by locating the finger 62 near the rearmost limit of the stroke of the bolt, the sear is held completely out of the path of the hammer as it is being cocked, so that the hook 30 of the sear is not subjected to the rubbing action of the hammer as it is being cocked, thereby protecting the precision sear surfaces against wear and the formation of metal burrs which cause undesirable roughness and irregularity in trigger-pull when the gun is fired. Thus, as hereinbefore described, during the rearward stroke of the bolt, the sear is held by the trigger completely out of the path of the hammer until the hammer is fully cocked. On direct engagement of the disconnector 36 by the bolt just before it reaches its rearmost position, the sear is released and slips into position above the cocking notch on the hammer for cocking engagement therewith when the bolt starts forward on its return stroke.

What is claimed is:

1. In a firing mechanism for a repeating firearm having a reciprocal breech-bolt mechanism, a spring-loaded firing member mounted for movement into a cocked position on retraction of said breech-bolt mechanism, a sear resiliently urged into a cocking position for cocking said firing member, and a trigger for moving said sear out of such cocking position, a sear-disconnecting device comprising, a disconnector pivotally mounted on said trigger for movement therewith upon retraction and release of said trigger and for pivotal movement relative to said trigger about a pivot axis, said disconnector having a foot portion on one side of said pivot axis disposed for operative engagement with said sear such that said firing member is released when said trigger is retracted, spring means for resiliently urging said foot portion of said disconnector into operative engagement with said sear, said disconnector having a finger portion disposed on the opposite side of said pivot axis from said foot portion and extending into the path of said breech-bolt mechanism for movement thereby against the urging of said spring means when said breech-bolt mechanism is retracted, said foot portion being thereby moved to an inoperative position out of engagement with said sear such that said sear is free to return to its cocking position.

2. A sear-disconnecting device as defined in claim 1, wherein said firing member is a hammer pivoted forward of said sear for pivotal movement between a cocked position and a firing position, said hammer being disposed for engagement by said breech-bolt mechanism upon retraction thereof so that said hammer is pivoted into its cocked position by said breech-bolt mechanism, said finger portion of said disconnector being disposed rearwardly of said sear for engagement by said breech-bolt mechanism during its rearward stroke after said hammer has been moved to its cocked position, such that said sear is freed by said disconnector for cocking engagement with said hammer only when said hammer is in its cocked position.

* * * * *